United States Patent [19]

Besemann et al.

[11] 4,432,262

[45] Feb. 21, 1984

[54] DRIVING UNIT FOR THE KNIFE HOLDERS OF CROSS CUTTERS OR THE LIKE

[75] Inventors: Alfred Besemann, Hamburg; Willi Rehwald, Böblinger, both of Fed. Rep. of Germany

[73] Assignee: E. C. H. Will (GmbH & Co.), Hamburg, Fed. Rep. of Germany

[21] Appl. No.: 488,782

[22] Filed: Apr. 26, 1983

[30] Foreign Application Priority Data

Jun. 28, 1980 [DE] Fed. Rep. of Germany ..... 3024603

[51] Int. Cl.[3] ..... D06H 7/02

[52] U.S. Cl. ..... 83/311

[58] Field of Search ..... 83/311, 324; 74/393

[56] References Cited

U.S. PATENT DOCUMENTS 2,764,033 9/1956 Lane ..... 83/311 X 3,352,171 11/1967 Skiera ..... 74/393

FOREIGN PATENT DOCUMENTS 1502767 7/1969 Fed. Rep. of Germany ..... 83/311

*Primary Examiner*—James M. Meister

*Attorney, Agent, or Firm*—Kontler, Grimes & Battersby

[57] ABSTRACT

One of the two knife holder shafts in a cross cutter for webs of paper or the like is driven by a unit wherein a motor rotates the input shaft of a bevel gear drive whose output shaft drives or constitutes one shaft of a universal joint. The other shaft of the universal joint is driven by the one shaft and transmits torque to the knife holder shaft or shafts by way of a step-up gear transmission and a clutch which allows for changes in angular positions of the knife holder shafts with reference to the universal joint. An extension of the axis of the input shaft of the bevel gear drive intersects the axes of the shafts of the universal joint at the point where the axes of the shafts of the universal joint intersect each other. To this end, the other shaft of the universal joint contains an elastically deformable but torsion-resistant insert. The angle between the axes of the shafts in the universal joint can be changed by a carrier which is turnable about the axis of the input shaft of the bevel gear drive and rotatably supports the one shaft of the universal joint.

12 Claims, 2 Drawing Figures

PM

DRIVING UNIT FOR THE KNIFE HOLDERS OF CROSS CUTTERS OR THE LIKE

This is a division of our copending application Ser. No. 275,663 filed June 22, 1981.

CROSS-REFERENCE TO RELATED CASES

Apparatus which sever running webs of paper or the like at desired intervals to form a succession of discrete sheets are disclosed in U.S. Pat. Nos. 4,201,102 and 4,255,998 to Rudszinat respectively granted May 6, 1980 and Mar. 17, 1981.

BACKGROUND OF THE INVENTION

The present invention relates to apparatus for severing one or more running webs, strips, tapes or bands of paper, textile material, cardboard, metallic foil, plastic foil or the like, and more particularly to improvements in driving units for so-called cross cutters which are utilized to repeatedly sever a running web, band, strip or tape at desired intervals so that the running material yields a file of discrete plates, panes, panels or sheets. As a rule, such cross cutters employ one or more orbiting knives which are adjacent to the path of lengthwise movement of the material to be severed and each of which severs the web, band, strip or tape once during each of its orbital movements.

It is already known to drive the knife or knives of a cross cutter by a unit which employs universal joints serving to ensure that the knife or knives advance at the speed of the material to be severed in the course of the actual severing operation but that the knife or knives move or can move at a different speed during travel away from and back to the severing station. The angle between the axes of the input and output shafts of the universal joints can be varied by a mechanism which normally includes an angle drive and serves to change the inclination of the input shaft with reference to the output shaft. Reference may be had to East German Pat. No. 51,105 which discloses a driving unit having a drive shaft mounted in parallelism with the shaft for the knife of the cross cutter. The drive shaft is connected with a first bevel gear through the medium of a pair of universal joints and a telescoped shaft between the two joints. The first bevel gear mates with a second bevel gear which is movable lengthwise of a splined shaft. Furthermore, the two bevel gears are connected to each other by a bearing so that the first bevel gear is compelled to share the movements of the second bevel gear in the axial direction of the splined shaft. The latter extends transversely of the knife shaft and of the drive shaft and is connected with the knife shaft by a second pair of bevel gears.

A drawback of the just described patented driving unit is that it is bulky, complex and expensive. Furthermore, the play between the parts which are movable with reference to each other is quite pronounced, especially if one compounds the clearances between all of the elements which are installed between the input element of the driving unit and the knife shaft. Such pronounced play is of no consequence in connection with the production of certain commodities, such as in bag making machines which are specifically referred to in the East German patent. However, an accurate and reproducible cutting operation is quite important in certain other fields, such as in the making of steno pads, exercise books, memo pads and like stationery products wherein the neighboring sheets and/or covers must overlie each other with a high degree of accuracy.

OBJECTS AND SUMMARY OF THE INVENTION

An object of the invention is to provide a novel and improved driving unit for the moving parts of a cross cutter and to construct and assemble the driving unit in such a way that it is simpler, more compact and less expensive than heretofore known driving units.

Another object of the invention is to provide a driving unit whose versatility considerably exceeds that of heretofore known driving units and which can transmit motion to a cross cutter in such a way that the severing action is more reproducible than in machines utilizing cross cutters and conventional driving units therefor.

An additional object of the invention is to provide the driving unit with novel and improved means for varying the length of sheets, plates, panes, panels or like products which are obtained in response to repeated severing of a running web, strip, tape or band of paper, cardboard, textile material, synthetic plastic material or metallic foil.

Still another object of the invention is to provide the driving unit with novel and improved means for selecting the speed at which the knife or knives of the cross cutter move in the course of the actual severing operation.

An ancillary object of the invention is to provide a novel and improved universal joint for use in a driving unit of the above outlined character.

Still another object of the invention is to provide a novel combination of an angle drive and a universal joint for use in a driving unit of the above outlined character.

A further object of the invention is to provide novel and improved torque transmitting means between the driving unit and the shaft or shafts of the knife holder or holders in the cross cutter.

Still another object of the invention is to provide a novel and improved separable connection between the aforementioned driving unit and the cross cutter.

The invention resides in the provision of a driving unit for a rotary member (e.g., a shaft which carries a drum-shaped knife holder) in a cross cutter for one or more running webs of paper or the like. The driving unit comprises an angle drive (e.g., a pair of mating bevel gears and their shafts) having a rotary input element (such as the shaft for one of the bevel gears, and a rotary output element (such as the shaft for the other bevel gear) receiving torque from the input element, a prime mover or other suitable means for rotating the input element of the angle drive, and a universal joint including a rotary input shaft which is driven by the angle drive, which may constitute the output element of the angle drive and which has a first axis, and a rotary output shaft which is driven by the input shaft and has a second axis intersecting the first axis at a predetermined point. One of the shafts is movable with reference to the other shaft to thereby change the angle between the first and second axes, and the input element of the angle drive has a third axis which intersects the first and second axes at the aforementioned point. The driving unit further comprises carrier means rotatably mounting the output element of the angle drive and the input shaft and being movable about the third axis to thereby change the aforementioned angle, and means for transmitting torque from the output shaft of the universal joint to the rotary member of the cross cutter.

At least one of the shafts in the universal joint preferably includes at least one elastically bendable torsion-resistant element; such torsion-resistant element can be interposed between two normally coaxial portions of the output shaft.

The torque transmiting means preferably comprises a transmission, especially a step-up gear transmission with a ratio of two-to-one. Furthermore, the torque transmitting means may comprise means for changing the angular position of the rotary member in the cross cutter with reference to the universal joint, and such changing means preferably comprises a device for turning the rotary member of the cross cutter through 90 degrees with reference to the universal joint. The just mentioned device preferably includes a clutch which is interposed between the step-up transmission and the rotary member of the cross cutter and comprises a first clutch element driven by the transmission and a coaxial second clutch element driving the rotary member of the cross cutter. One of the clutch elements is connectable to the other clutch element in two different positions at an angle of 180 degrees to one another.

The driving unit can further comprise manually operated or motor driven means for turning the carrier means about the third axis to thereby change the aforementioned angle between the first and second axes, and such turning means can comprise mating gears (e.g., a gear segment on the carrier means and a pinion mating with the segment and being rotatable by hand or by a motor).

The novel features which are considered as characteristic of the invention are set forth in particular in the appended claims. The improved driving unit itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
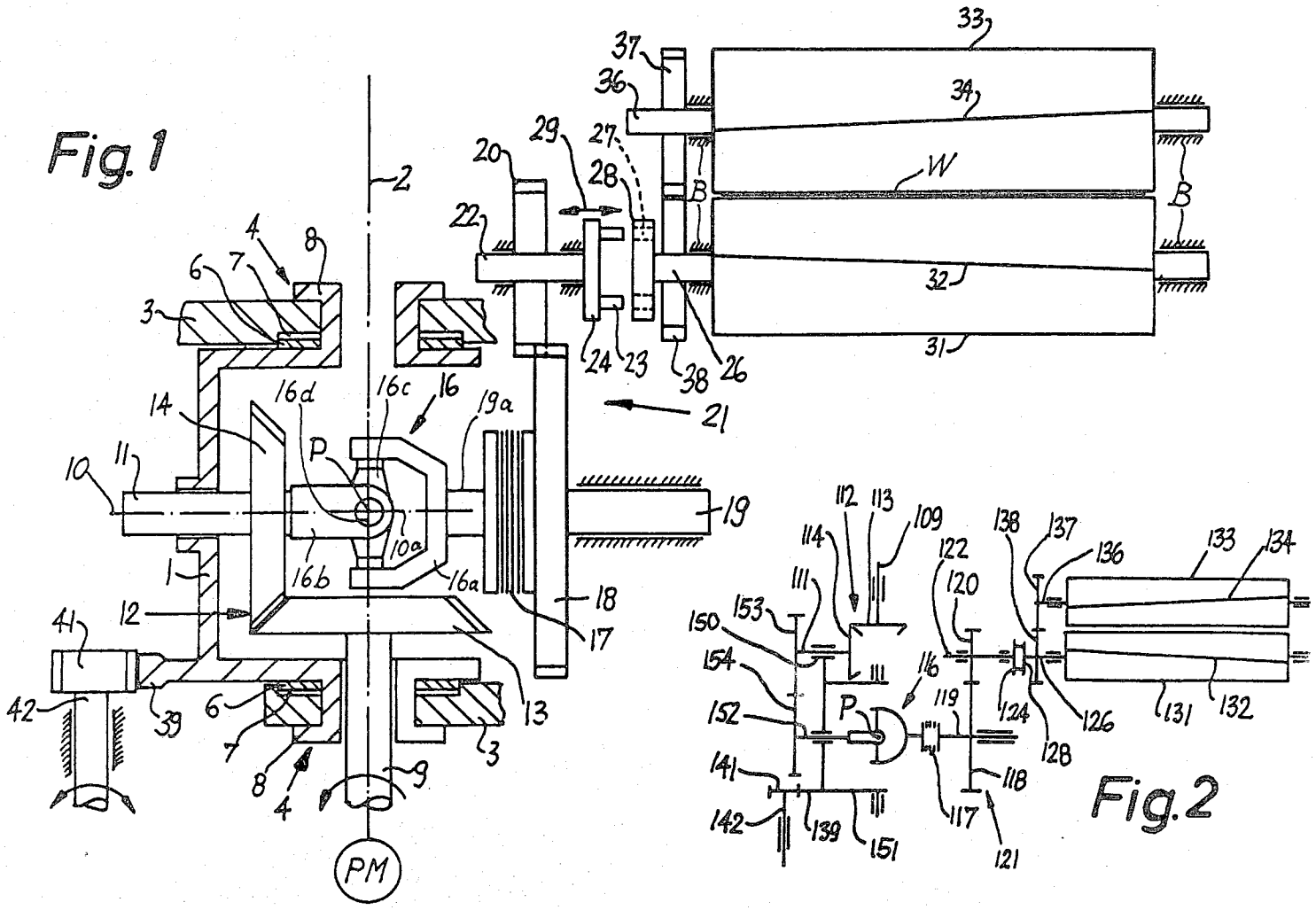
FIG. 1 is a schematic partly elevational and partly sectional view of a driving unit which serves to rotate the holders for two cooperating orbiting knives in a cross cutter and is constructed and assembled in accordance with a first embodiment of the invention.
FIG. 2 is a schematic elevational view of a modified driving unit.

Referring first to FIG. 1, there is shown a cross cutter including two rotary drum-shaped knife holders 31, 33 for elongated knives 32, 34 which cooperate with one another to sever, at desired intervals, at least one running web W of paper or the like. The web W is transported through the nip of the holders 31, 33 at right angles to the plane of FIG. 1 in a manner not forming part of the present invention. Reference may be had to U.S. Pat. No. 4,157,821 granted June 12, 1979 to Paul Fabrig. The shafts 26 and 36 of the respective knife holders 31, 33 are mounted in suitable bearings B which, in turn, are installed in the stationary frame 3 of the machine embodying the cross cutter. Such cross cutters are utilized in machines for the making of writing pads, exercise books, spiral bound steno pads or analogous stationery products.

In accordance with a feature of the invention, the driving unit for the shafts 26, 36 (which are kinematically connected to each other by mating spur gears 37, 38 so that they rotate at the same speed but in opposite directions) comprises a novel combination of a universal joint 16 and an angle drive 12. The latter comprises two mating bevel gears 13, 14 whose axes intersect each other at a point P and whose shafts are respectively denoted by the reference characters 9 and 11. The shaft 9 is the input shaft of the angle drive 12 and receives torque from a prime mover PM, e.g., the main prime mover of the machine wherein the cross cutter is installed and which serves to turn out pads, exercise books or like commodities (or simply a succession of paper sheets, plastic sheets or other sheet-like products of desired size and shape).

The shafts 9 and 11 for the bevel gears 13, 14 are journalled in a carrier 1 which is a substantially U-shaped body and is turnable about an axis 2 coinciding with the common axis of the input shaft 9 and bevel gear 13 and making an angle of 90 degrees with an axis 10 which is common to the shaft 11 and bevel gear 14. The carrier 1 is turnable about the axis 2 in the aforementioned stationary frame 3. The shaft 9 of the angle drive 12 is rotatable in one of two bearings 4, and each of these bearings comprises a disc-shaped annular bearing member 6 which is caused to bear against the adjacent portion of the carrier 1 under the action of a hydraulic fluid (e.g., oil) which is admitted into and maintained in pressurized condition in a cylinder chamber 7 of the frame 3. Those portions of the frame 3 which are formed with the chambers 7 constitute cylinders reciprocably receiving the corresponding bearing members 6. Each of these bearing members can be said to constitute an annular piston or plunger which is biased against the carrier 1 when the respective cylinder chamber 7 is filled with a pressurized hydraulic fluid. The carrier 1 has two collars 8 which are held in abutment with the adjacent portions of the frame 3 when the chambers 7 are filled with pressurized fluid. The two bearings 4 are coaxial with one another, i.e., the axis 2 constitutes a common axis for these bearings.

The output shaft 11 of the angle drive 12 constitutes the input shaft of the aforementioned universal joint 16 which further comprises an output shaft 19 carrying a gear 18. The connection between the shafts 11 and 19 comprises an elastically flexible or bendable but torsion-resistant torque transmitting element 17, e.g., an element made entirely of steel and manufactured by the firm A. Friedrich Flender GmbH & Co. KG, Bocholt, Federal Republic Germany. The inclination of the axis of the shaft 11 with reference to the axis **10*a* of the shaft 19 can be changed by turning the carrier 1 about the axis 2. Irrespective of the selected angular position of the carrier 1 with reference to the shaft 2, the axes 2, 10, 10*a* of the shafts 9, 11, 19** invariably intersect each other at the point P.

The gear 18 on the output shaft 19 of the universal joint 16 meshes with a gear 20 on an intermediate shaft 22 which is coaxial with the rotary member or shaft 26. The gears 18 and 20 constitute a step-up transmission 21 with a ratio of two-to-one, i.e., the RPM of the intermediate shaft 22 is twice that of the output shaft 19. The shaft 22 further carries the male element 24 of a clutch whose female element 28 is rigid with the shaft 26 for the knife holder 31. The male clutch element 24 has two pins 23 which are disposed diametrically opposite each other with reference to the axis of the shaft 22 and can enter complementary recesses or bores 27 of the clutch element 28. The shaft 22 is reciprocable in the directions indicated by a double-headed arrow 29 without necessarily moving the gear 20 out of mesh with the gear 18 of the step-up transmission 21. Thus, the clutch including the clutch elements 24 and 28 can be engaged in two different angular positions of the clutch element 28 with reference to the clutch element 24, and the angular spacing between such positions equals 180 degrees.

The carrier 1 has a gear segment 39 or a complete gear which meshes with a pinion 41 on a shaft 42. The latter can be rotated by hand or by a suitable servomotor to thereby turn the carrier 1 about the axis 2 and change the inclination of the axis 10 of the input shaft 11 with reference to the axis 10*a* of the output shaft 19. In other words, angular adjustability of the carrier 1 renders it possible to change the angle between the axes 10, 10*a* of the input and output shafts 11, 19 of the universal joint 16 while such axes continue to intersect each other and the axis 2 at the point P.

The operation of the driving unit of FIG. 1 is as follows:

The input shaft 9 of the angle drive 12 is rotated by the main prime mover of the machine embodying the cross cutter or by a discrete prime mover (such as the prime mover PM shown in FIG. 1) which is driven in synchronism with the main prime mover of the machine and rotates the input shaft 9 of the angle drive 12 at a constant angular speed. The bevel gears 13, 14 cooperate to rotate the output shaft 11 of the angle drive 12 at a speed which is identical with or proportional to the speed of the input shaft 9, depending on the ratio of the gears 13, 14 (it is assumed that the gears 13 and 14 are identical).

The angular velocity of the output shaft 19 of the universal joint 16 varies periodically in dependency on inclination of the axis 10 of the input shaft 11 with reference to the axis 10*a* of the output shaft 19. Such angle can be adjusted by turning the carrier 1 about the axis 2. As mentioned above, the output shaft 11 of the angle drive 12 constitutes the input shaft of the universal joint 16. This contributes to simplicity, lower cost and compactness of the driving unit. The non-uniform angular velocity of the output shaft 19 is transmitted to the shaft 26 by way of the step-up transmission 21, i.e., at the ratio of two-to-one, and the shaft 26 drives the shaft 36 at the same speed by way of the gearing 38, 37. The knives 32 and 34 cooperate to sever the web W when the angular velocity of their shafts 26 and 36 reaches the maximum or minimum value, i.e., when the angular velocity of the shaft 22 is highest or lowest. Whether the knives 32, 34 sever the web W while moving at the maximum speed or at the minimum speed depends on their angular positions with reference to the universal joint 16, and such angular positions can be changed by disengaging the clutch including the clutch elements 24, 28 (i.e., by moving the intermediate shaft 22 to the left-hand end position which is shown in FIG. 1), by thereupon rotating the clutch element 28 and knife holder 31) through an angle of 180 degrees (which, in view of selected transmission ratio of the transmission 21, corresponds to an angular displacement of the shaft 26 through 90 degrees with reference to the shaft 19 of the universal joint 16), and by finally reengaging the clutch (i.e., by moving the shaft 22 to its right-hand end position so as to reconnect the clutch element 24 with the clutch element 28 but after an angular displacement of the clutch element 28 through one-half of a full revolution). In other words, an angular displacement of the shaft 26 (and hence also of the shaft 36, holders 31, 33 and knives 32, 34) through 180 degrees entails an angular displacement of the knives 32, 34 through 90 degrees with reference to the universal joint 16.

The extent of lack uniformity of angular movement of the output shaft 19 during movement between the two angular positions in which the RPM of this shaft matches the RPM of the input shaft 11 can be varied in the aforedescribed manner, i.e., by the simple expedient of changing the position of the carrier 1 with reference to the axis 2. In other words, the carrier 1 can be turned by the shaft 42 and pinion 41 to change the inclination of the axis 10 of the input shaft 11 with reference to the axis 10*a* of the output shaft 19 of the universal joint 16.

It will be noted that the angle drive 12 is located upstream or ahead of the universal joint 16, as considered in the direction of power flow from the prime mover PM to the shafts 26, 36 of the cross cutter, and that the axis (2) of the input shaft 9 of the angle drive 12 intersects the axes 10, 10*a* of the input and output shafts 11, 19 of the universal joint 16 at one and the same point P. This contributes to compactness of the improved driving unit and to substantial reduction of the overall number of component parts so as to reduce the likelihood of excessive or extensive wear, unnecessary play between moving parts and cost of the driving unit. The provision of the carrier 1 which is turnable about the axis 2 of the input shaft 9 renders it possible to change the angle between the axes 10, 10*a* of the shafts 11, 19 (i.e., the angle between the axes of the shafts forming part of the universal joint 16 and hence the extent of deviation of angular velocity of the output shaft 19 from the angular velocity of the shaft 11 during certain stages of rotation of the shaft 19). The driving unit of the present invention employs a single angle drive and a single universal joint. This constitutes a substantial simplification when compared with the driving unit of the aforediscussed East German Pat. No. 51,105 which employs two universal joints and two angle drives. Furthermore, the improved driving unit need not employ a splined shaft for axial movement of component parts of the angle drive and/or a composite (telescoped) cardanic shaft between a pair of universal joints. All this greatly reduces the space requirements, complexity and cost of the improved driving unit and reduces the likelihood of undesirable play between the articulately connected parts of the improved driving unit.

The driving unit of FIG. 1 exhibits the additional advantage that the output shaft 11 of its angle drive 12 constitutes the input shaft of the universal joint 16. This further reduces the space requirements and enhances the simplicity of the driving unit.

As stated above, the axes 10, 10*a* of the shafts 11, 19 of the universal joint 16 intersect each other at a point P where such axes also intersect the axis 2 of the input shaft 9 of the angle drive 12. As a rule, this requirement cannot always be satisfied with a maximum degree of accuracy owing to manufacturing and assembling tolerances. The aforementioned elastically bendable but torsion-resistant element 17 is provided in order to counteract the forces which develop as a result of possible presence of aforementioned tolerances, i.e., in the event of lack of intersection of all of the aforementioned axes (of the shafts 9, 11 and 19) at a single point. The element 17 can be installed between another pair of shafts including the shafts 9, 11 and 19, e.g., between the shafts 9 and 11. Actually, the element 17 is installed between two sections or portions of a composite output shaft of the universal joint 16, namely, between the shaft 19 which carries the gear 18 and the shaft 19*a* for the fork 16*a* which is articulately connected with the fork 16*b* on the shaft 11 by two pins 16*c*, 16*d* in a manner well known from the art of such types of universal joints.

The output element of a universal joint exhibits a non-uniformity period of 180 degrees for each angular displacement of its input element through 360 degrees, i.e., each revolution of the input element entails two periodically recurring non-uniformities. Thus, the knife shaft 26 could carry two knives at an angle of 180 degrees to one another. By changing the angle between the axes 10, 10*a* of the shafts 11 and 19 between 0 and 54 degrees, one can change the length of successively severed sheets within a range of 1 to 1.73. Instead of utilizing a cross cutter having a single shaft 26 with two knives on the respective holder 31, the illustrated driving unit employs the aforementioned step-up transmission 21 which is interposed between the universal joint 16 and the knife shaft 26 to double the length of the zone (as considered in the circumferential direction of the carrier 31) wherein the knife 32 and the web W move in synchronism with one another i.e., in which the speed of orbital movement of the knife 32 (and hence of the associated knife 34) matches the speed of lengthwise movement of the web W through the nip of the holders 31, 33. This enhances the quality of the severing operation.

The provision of clutch means including the clutch elements 24 and 28 enables an operator to change the orientation of the knives 32, 34 with reference to the universal joint 16 by 90 degrees. This results in a widening of the aforementioned format range to 1:3 because, by changing the angular positions of the knives relative to the universal joint 16, one can utilize both sinusoidal half waves of the periodical non-uniformity movement of the output shaft 19.

FIG. 2 illustrates a cross cutter and a modified driving unit therefor. All such parts of the apparatus shown in FIG. 2 which are identical with or clearly analogous to corresponding parts of the structure shown in FIG. 1 are denoted by similar reference characters plus 100. For example, the knives of the cross cutter are shown at 132 and 134, their holders at 131, 133, the step-up gear transmission at 121, the flexible torsion-resistant torque transmitting element between the shafts 152, 119 of the universal joint 116 at 117, etc. The difference between the two driving units is that the carrier 151 of FIG. 2 rotatably mounts the output shaft 111 of the angle drive 112 as well as the discrete input shaft 152 of the universal joint 116. The shaft 152 is parallel to the shaft 111, and the latter is rotatable in a bearing 150 of the carrier 151. The shaft 111 drives the shaft 152 through the medium of a gearing including mating gears 153, 154 having identical diameters. In all other respects, the driving unit of FIG. 2 is identical with or clearly analogous to the driving unit of FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A driving unit for a rotary member in a cross cutter for running webs of paper or the like, comprising an angle drive having a rotary input element and a rotary output element receiving torque from said input element; means for rotating said input element; a universal joint including a rotary input shaft driven by said angle drive and having a first axis and a rotary output shaft driven by said input shaft and having a second axis intersecting said first axis at a predetermined point, one of said shafts being movable with reference to the other of said shafts to thereby change the angle between said axes and said input element having a third axis intersecting said first and second axes at said point; carrier means rotatably mounting said output element and said input shaft and turnable about said third axis; and means for transmitting torque from said output shaft to the rotary member of the cross cutter.

2. The driving unit of claim 1, wherein one of said shafts includes an elastically bendable torsion-resistant element.

3. The driving unit of claim 2, wherein said one shaft is said output shaft.

4. The driving unit of claim 1, wherein said angle drive comprises a first bevel gear coaxial with said input element and a second bevel gear coaxial with said output element and mating with said first bevel gear.

5. The driving unit of claim 1, wherein said torque transmitting means comprises a transmission.

6. The driving unit of claim 5, wherein said transmission is a step-up transmission.

7. The driving unit of claim 6, wherein the ratio of said transmission is two-to-one.

8. The driving unit of claim 1, wherein said torque transmitting means comprises means for changing the angular position of the rotary member in the cross cutter with reference to said universal joint.

9. The driving unit of claim 8, wherein said changing means includes a device for turning the rotary member of the cross cutter through 90 degrees with reference to said universal joint.

10. The driving unit of claim 9, wherein said torque transmitting means further comprises a step-up transmission interposed between said output shaft and said device and having a ratio of two-to-one, said device comprising a clutch having a first clutch element driven by said transmission and a second clutch element driving the rotary member of the cross cutter, one of said clutch elements being connectable to the other of said clutch elements in two different positions at 180 degrees to one another.

11. The driving unit of claim 1, further comprising means for turning said carrier means about said third axis and for thereby changing said angle.

12. The driving unit of claim 11, wherein said turning means comprises mating gears.

* * * * *